US007490617B2

(12) United States Patent
Bell et al.

(10) Patent No.: US 7,490,617 B2
(45) Date of Patent: Feb. 17, 2009

(54) STEP EXTENDING APPARATUS

(75) Inventors: Frank Brabson Bell, Isle of Palms, SC (US); Richard Martin Jones, Isle of Palms, SC (US)

(73) Assignee: Step Extender, LLC, Isle of Palms, SC (US)

( * ) Notice: Subject to any disclaimer, the term of this patent is extended or adjusted under 35 U.S.C. 154(b) by 438 days.

(21) Appl. No.: 10/263,620

(22) Filed: Oct. 3, 2002

(65) Prior Publication Data

US 2003/0111100 A1 Jun. 19, 2003

Related U.S. Application Data

(60) Provisional application No. 60/340,216, filed on Dec. 14, 2001.

(51) Int. Cl.
*A61H 3/00* (2006.01)

(52) U.S. Cl. ..... 135/66; 135/67; 135/84; 482/52; 482/67; 182/106; 297/423.41

(58) Field of Classification Search ..... 135/65–67, 135/84, 82, 69, 75; 482/51–53, 66–68, 35, 482/36, 75; 182/106, 113; 5/81.1; 4/254; 297/423.41

See application file for complete search history.

(56) References Cited

U.S. PATENT DOCUMENTS

| | | | | |
|---|---|---|---|---|
| 1,394,224 | A | 10/1921 | Scott | |
| 2,474,722 | A | 6/1949 | Blume | |
| 2,642,074 | A * | 6/1953 | Pedley et al. | 135/65 |
| 2,708,473 | A | 5/1955 | Gable et al. | |
| 2,782,796 | A | 2/1957 | Blue | |
| 3,077,347 | A * | 2/1963 | Nova | 482/142 |
| 3,176,700 | A | 4/1965 | Drury, Jr. | |
| 3,354,893 | A | 11/1967 | Schmerl | |
| 3,387,617 | A | 6/1968 | Reiber | |
| 3,387,618 | A | 6/1968 | Swann | |

(Continued)

FOREIGN PATENT DOCUMENTS

JP 11262504 A * 9/1999

(Continued)

OTHER PUBLICATIONS

"Exhibit A" flyer for Universal Stair-Climbing Walker. Functions as a regular walker or, when using the extended handle grips, it aids in ascending and descending stairs.

*Primary Examiner*—Winnie Yip
(74) *Attorney, Agent, or Firm*—Dority & Manning, P.A.

(57) ABSTRACT

A step-extending device is adapted for use in association with a walker to ascend or descend a stairway. The step-extending device may employ a first base and a second base, each of which is adapted to receive legs of a walker upon respective upper surfaces. The device may be used in connection with a frame that connects the first and second bases to each other. A cross member connects first and second bases. A frame includes one or more upright members with handles adapted for grasping and moving the step-extending device from one stair to another stair during use. The height of each of the first and second support bases is adjusted to approximate the height of stairs upon a stairway, so that stairs of essentially any height may be accommodated.

7 Claims, 6 Drawing Sheets

U.S. PATENT DOCUMENTS 3,421,529 A * 1/1969 Vestal ..... 135/67
3,455,313 A 7/1969 King
3,688,789 A 9/1972 Bunch
3,907,068 A * 9/1975 Ulerich ..... 182/194
4,094,331 A * 6/1978 Rozsa ..... 135/67
4,411,283 A * 10/1983 Lucarelli ..... 135/67
4,539,977 A * 9/1985 Schneider, Sr. ..... 482/34
4,561,652 A * 12/1985 Wilkinson ..... 482/105
4,678,234 A * 7/1987 Wilson ..... 297/423.45
4,844,199 A * 7/1989 Nimz ..... 182/106
4,869,279 A 9/1989 Hedges
4,941,496 A * 7/1990 Berning ..... 135/67
5,118,101 A 6/1992 Belli
5,154,678 A * 10/1992 Adamczyk et al. ..... 482/52
5,158,512 A * 10/1992 Irwin et al. ..... 482/52
5,176,596 A 1/1993 Ullman
5,275,426 A * 1/1994 Tankersley ..... 280/87.051
5,318,057 A 6/1994 Wallum
5,349,977 A 9/1994 Wood
5,465,744 A * 11/1995 Browning ..... 135/67
5,499,645 A 3/1996 Baliga
5,593,370 A * 1/1997 Meldeau ..... 482/51
5,603,517 A 2/1997 Lorman
5,626,539 A 5/1997 Piaget et al.
5,649,558 A 7/1997 Richard
5,667,207 A * 9/1997 Pistole ..... 269/69
5,787,913 A 8/1998 Li
5,924,249 A * 7/1999 Kroll et al. ..... 52/184
5,941,262 A 8/1999 Tschirhart
5,957,146 A 9/1999 Corey
5,967,261 A 10/1999 Sandham et al.
5,979,476 A 11/1999 Cranny
6,145,524 A 11/2000 Li et al.
6,148,448 A * 11/2000 Urso ..... 4/254
6,164,305 A * 12/2000 Herman ..... 135/68
6,206,805 B1 * 3/2001 Helton et al. ..... 482/52
6,244,285 B1 * 6/2001 Gamache ..... 135/67
6,494,816 B1 * 12/2002 Corrado ..... 482/79

FOREIGN PATENT DOCUMENTS

WO WO 99/34761 * 7/1999

* cited by examiner

STEP EXTENDING APPARATUS

CROSS REFERENCE TO RELATED APPLICATIONS

This application claims priority to pending U.S. Provisional Application Ser. No. 60/340,216 filed Dec. 14, 2001.

BACKGROUND OF THE INVENTION

Walking aids for aged and disabled persons include canes, walkers, and the like. A cane is a device designed to be held in one hand, and it usually includes a support leg extending from the ground to a user's hand. A walker typically provides at least four legs and provides significant support and stability as compared to a cane. A walker usually will stand without external support, and commonly provides at least two hand grasping positions or handles. Persons using walkers may step among or between the four legs of the walker for maximum support during walking. Walkers are shown for example in U.S. Pat. Nos. 3,445,313; 4,441,283; 2,708,473; 5,603,517; 6,145,524; 5,787,913; 5,649,558; 5,499,645; and 5,979,146.

Aged or disabled persons frequently must ascend and descend stairs in connection with their daily activities. Many homes and businesses provide stairways as the only means of moving between floors. Stair climbing is a human activity that requires strong legs, flexible joints, and a fair amount of dexterity. Stair climbing is sometimes very difficult for disabled persons. Most canes and walkers perform poorly or not at all on stairways. Walkers cannot function well on stairs because of the large difference in height between adjacent stairs, which is typically about eight inches or more. Attempts to use standard walkers on stairways can sometimes be very dangerous, due to the instability of a walker when it is not placed upon a level footing.

Physical therapists sometimes advise patients to sit down and slide from one stair to another when ascending or descending a stairway. This sliding method is quite cumbersome, particularly when the patient must carry or pull a cane or walker with them. Furthermore, once the patient has reached his or her destination by such a method, he or she then must rise to an erect standing position, which is very difficult for elderly patients and those without full use of both legs.

Several devices have been developed to ease the burden of traversing a stairway. For example, U.S. Pat. No. 5,957,146 (the "Corey patent") is directed to a device that is designed to span more than one stair at a time. The Corey patent describes a moveable banister that is unilateral (i.e. supports one hand).

Walkers designed for climbing stairs have been disclosed. See for example, U.S. Pat. Nos. 6,145,524; 5,787,913; 5,649,558; and 5,603,517. Several of the devices described in these patents include telescoping legs, in which the two "downhill" legs of a four-legged walker may be temporarily telescoped to a longer position. This adjustment requires a fair amount of manual dexterity to activate a leg lengthening mechanism. Further, it sometimes requires that the disabled person lean against a wall or another person while the walker is being modified to assume a stair climbing telescoped mode of operation.

What is needed in the industry is a convenient and efficient means of assisting a disabled or elderly person in ascending and descending a stairway. A device that is relatively easy to operate and does not require substantial fine motor skills would be desirable. Furthermore, a device that may be used in association with existing walkers would be very helpful. In particular, a device that is capable of temporarily adjusting for and extending stair height so that adjacent stairs on a stairway exhibit the same effective height would be very helpful. Furthermore, a device that can be used with a variety of stair tread heights would be quite versatile and helpful.

SUMMARY OF THE INVENTION

A step-extending device is disclosed for use with a walker. The step-extending device, in one embodiment, includes a first base, a second base, and a frame operably connected to the first and second bases. The frame includes a cross member including a first end and a second end. The cross member extends from the first base at its first end to the second base at its second end. The cross member can be provided with an adjustment mechanism such as a spring-loaded detent for adjusting the length of the cross member. The first and second bases are employed to enhance the height of stairs, providing a height-adjusted surface upon which to place legs of a walker in ascending or descending the stairway. The first and second bases have flat undersides to rest on the step and flat upper surfaces which are adapted to receive and support walker legs.

In one embodiment of the invention, a first upright member is fixed in relation to at least one of the bases, and one end of the first upright member projects upward.

In yet another embodiment of the invention, two or more upright members may be employed. In that instance, the two upright members may be connected to each other at the top portion of each respective upright member by a horizontal bar which facilitates transport and placement of the device and has a length that may be adjusted by an adjustment mechanism. The length of each upright member also may be selectively adjustable by an adjustment mechanism. An extension may be pivotally connected to the horizontal bar and optionally pivoted to a position parallel to the horizontal bar when not in use.

In one embodiment of the invention, the step-extending device is configured with a cross member connecting the first and second bases, with an upright member projecting upwards from the cross member. A height adjustment means or mechanism may be used to adjust the height of the first and second bases from a first height to a second height to aid a patient who is ascending or descending a stairway with steps disposed at different heights. One embodiment of the height adjusting mechanism includes a plurality of units forming each base. The step-extending device may be configured for assuming two modes, each mode comprising a different base height for the first and second bases. First and second hinges, each having lower and upper portions, are connected to units forming each base. The hinges facilitate upward pivoting movement of units which are interlocked to each other and attached to the upper portion of the respective hinges.

A flip bar may be operably connected to units and attached to the upper portion of the respective hinges. Actuation of the flip bar may cause units which are connected to the upper portion of the hinge to assume a "flipped" mode or "second" mode. The flip bar may be actuated by movement using a person's foot, or alternately by actuation of a lever operably connected to the flip bar.

Another embodiment of a step-extending device may be employed using a self-adjusting feature, which adjusts to stair height differentials without the necessity of having a pre-set, predetermined height. The embodiment includes a first base, a second base, and a frame having first and second uphill legs supported on a first stair. First and second downhill legs are provided and adapted for support on a second stair, i.e. a next adjacent lower stair. A lateral member also is provided. The lateral member includes a first end and a second end, and is connected to the first downhill leg on its first end and to the second downhill leg on its second end. In one particular embodiment, a first latching member having holes spaced along its length extends between the first uphill and the first downhill leg, with a first end pivotally connected to the first uphill leg and a second end pivotally connected to the first downhill leg. In one particular embodiment, a second latching member having holes spaced along its length extends between the second uphill leg and the second downhill leg, with a first end pivotally connected to the second uphill leg and a second end pivotally connected to the second downhill leg. The latching members releasably engage downhill legs using pegs that mate with respective holes so as to adjust the height of the first and second bases relative to the stair.

BRIEF DESCRIPTION OF THE DRAWINGS

A full and enabling disclosure of this invention, including the best mode shown to one of ordinary skill in the art, is set forth in this specification. The following Figures illustrate the invention.

DETAILED DESCRIPTION OF THE INVENTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention.

Figure 1:
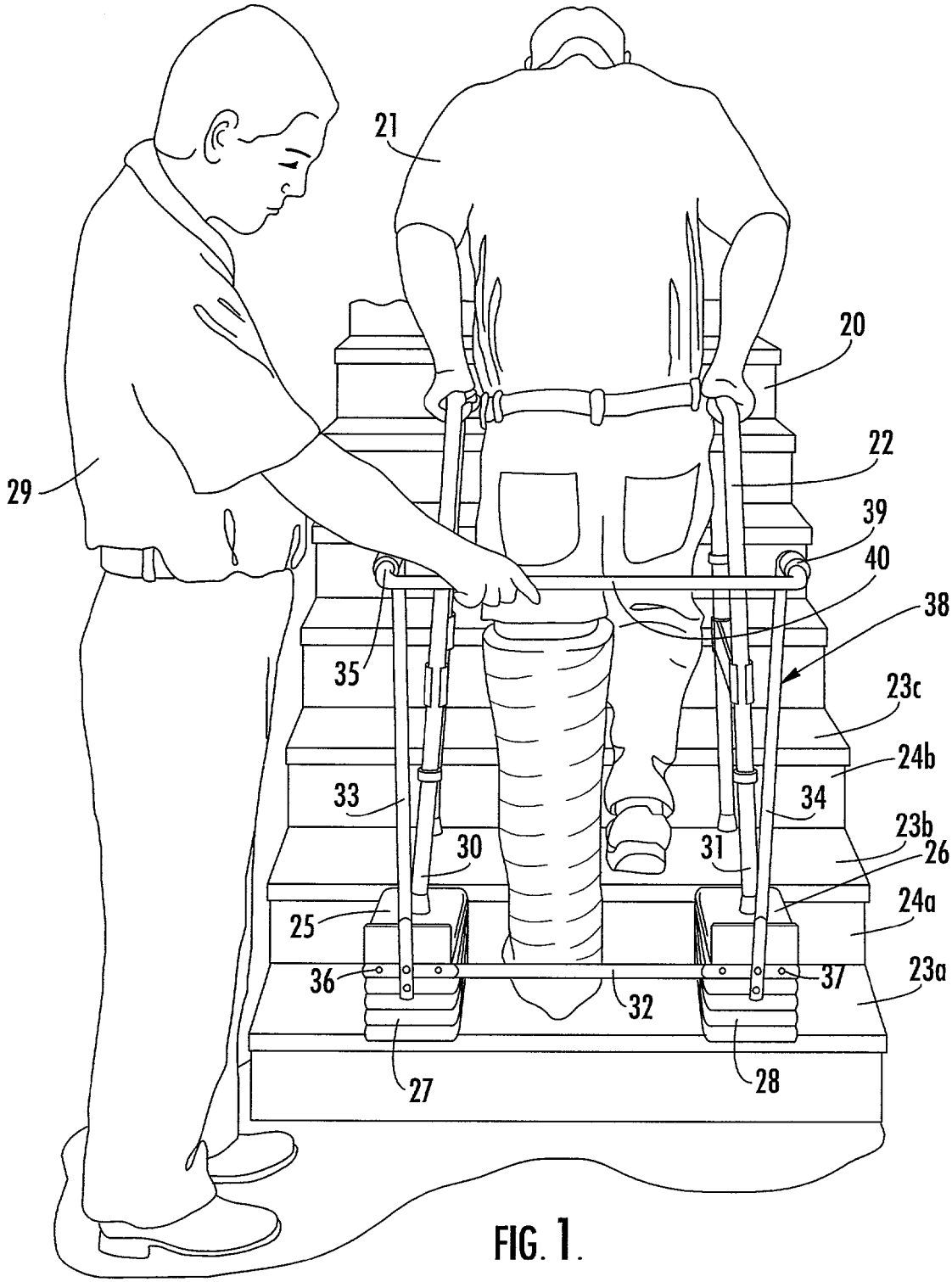
FIG. 1 illustrates a patient using an embodiment of the step extension device of the invention in association with a walker to ascend a stairway.

A first embodiment of the invention is illustrated in FIG. 1, and generally designated by the numeral 38. A stairway 20 is illustrated with a patient 21 shown in the process of ascending the stairway 20 using a walker 22. An assistant 29 is shown in the left side of FIG. 1, assisting the patient 21.

Stair treads 23*a-c* are shown, which form respective flat surfaces upon which the step-extending device 38 is placed, in successive movements. Stair risers 24*a* and 24*b* are also shown in FIG. 1, positioned vertically between respective stair treads 23*a-c*. Stair risers 24*a* and 24*b* determine the height differential between respective stair tread 23*a*-23*b* upper surfaces.

As the patient 21 ascends the stairs, the assistant 29 is capable of moving the step-extending device 38 along stairway 20, from a stair tread 23*a* disposed at one level to a stair tread 23*b* disposed at a next higher level. The step-extending device 38 is configured for movement from a position upon stair tread 23*a* to stair tread 23*b*, to stair tread 23*c*, and the like, each time forming a platform for supporting legs of walker 22, as further described herein.

The step-extending device 38 includes a first base 27 and a second base 28, connected by a cross member 32. The first base 27 and second base 28 further include upper surfaces 25-26, respectively, which are configured to receive legs of a walker, as further described herein. The bases 27-28 provide a respective planar underside for resting upon a stair. The first base 27 and second base 28 (see FIG. 2) serve to stabilize the step-extending device 38, as well as providing for height adjustment to bring steps into the same (or nearly the same) vertical alignment. The bases 27, 28 are defined by a flat planar underside and a flat upper side, the underside of each of said bases 27, 28 being configured to rest upon a step.

A cross member 32 is connected at its first end 36 to first base 27. This connection preferably is by way of a screw inserted through the first end 36 of cross member 32 into first base 27. In other embodiments, a rivet could be employed to fix the first end 36 of cross member 32 to first base 27. In yet another embodiment, a bolt could be used. The cross member 32 is connected at its second end 37 to second base 28 in the same manner as previously described for first end 36.

Furthermore, a first upright member 33 extends vertically and is connected to cross member 32, by way of a screw (or other mechanical fastener) secured into second base 28. A second upright member 34 is connected to the cross member 32, desirably near the second end 37 of said cross member 32. A horizontal bar 40 connects the first and second upright members 33, 34 near the upper end 44 of the step-extending device 38.

Figure 2:
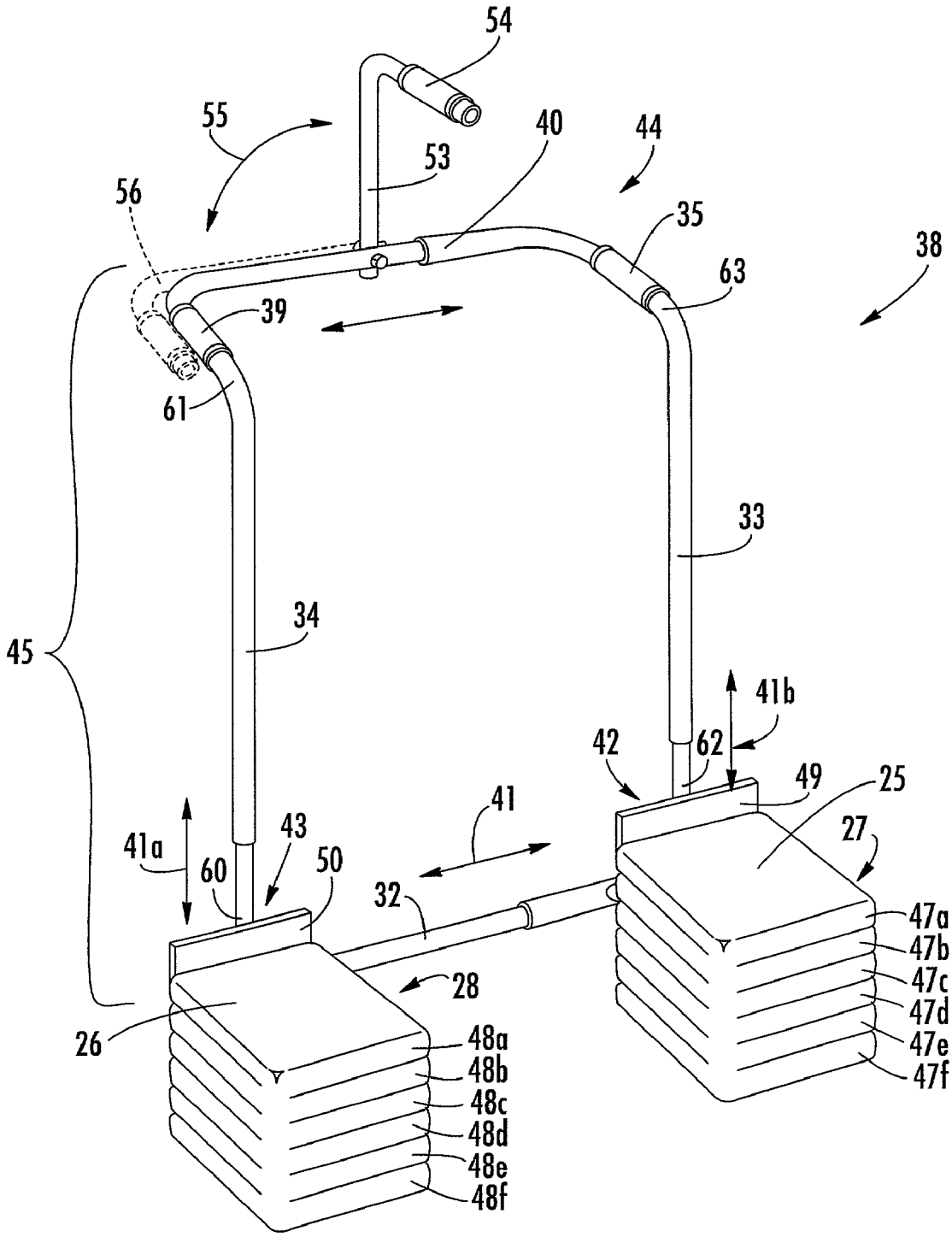
FIG. 2 is a perspective view of a first embodiment of the invention, as employed in FIG. 1.

As shown in FIG. 2 for example, a first handle grip 35 is shown near the upper end of the first upright member 33, and a second handle grip 39 is shown near the upper end of the second upright member 34. As shown in FIG. 1, the assistant 29 may grasp horizontal bar 40 to lift the step-extending device 38 from its position upon stair tread 23*a* to the next successive stair tread, i.e., stair tread 23*b*. Each time the step-extending device 38 is moved to another stair, the walker 22 may be repositioned so that the first downhill leg 30 and the second downhill leg 31 of the walker are placed upon the first base 27 and second base 28, respectively. In this way, the first base 27 and the second base 28 effectively extend the width of the stair treads 23*a-b*, providing a relatively flat surface for supporting each of the four legs of a walker 22.

Step-extending device 38 may be used to ascend or descend a stairway. FIG. 1 shows one example of the patient 21 while he is in the process of ascending the stairway. When a patient 21 descends a stairway 20, a similar procedure is used, except that the step-extending device 38 is moved down the stairway 20, as from stair tread 23*c*, to stair tread 23*b*, to stair tread 23*a*, and the like. Similarly, when descending a stairway 20 the walker 22 is repositioned so that the first downhill leg 30 contacts the upper surface of the first base 27, while the second downhill leg 31 contacts the upper surface of the second base 28, stabilizing the walker 22 at each step during the descent.

Figure 3:
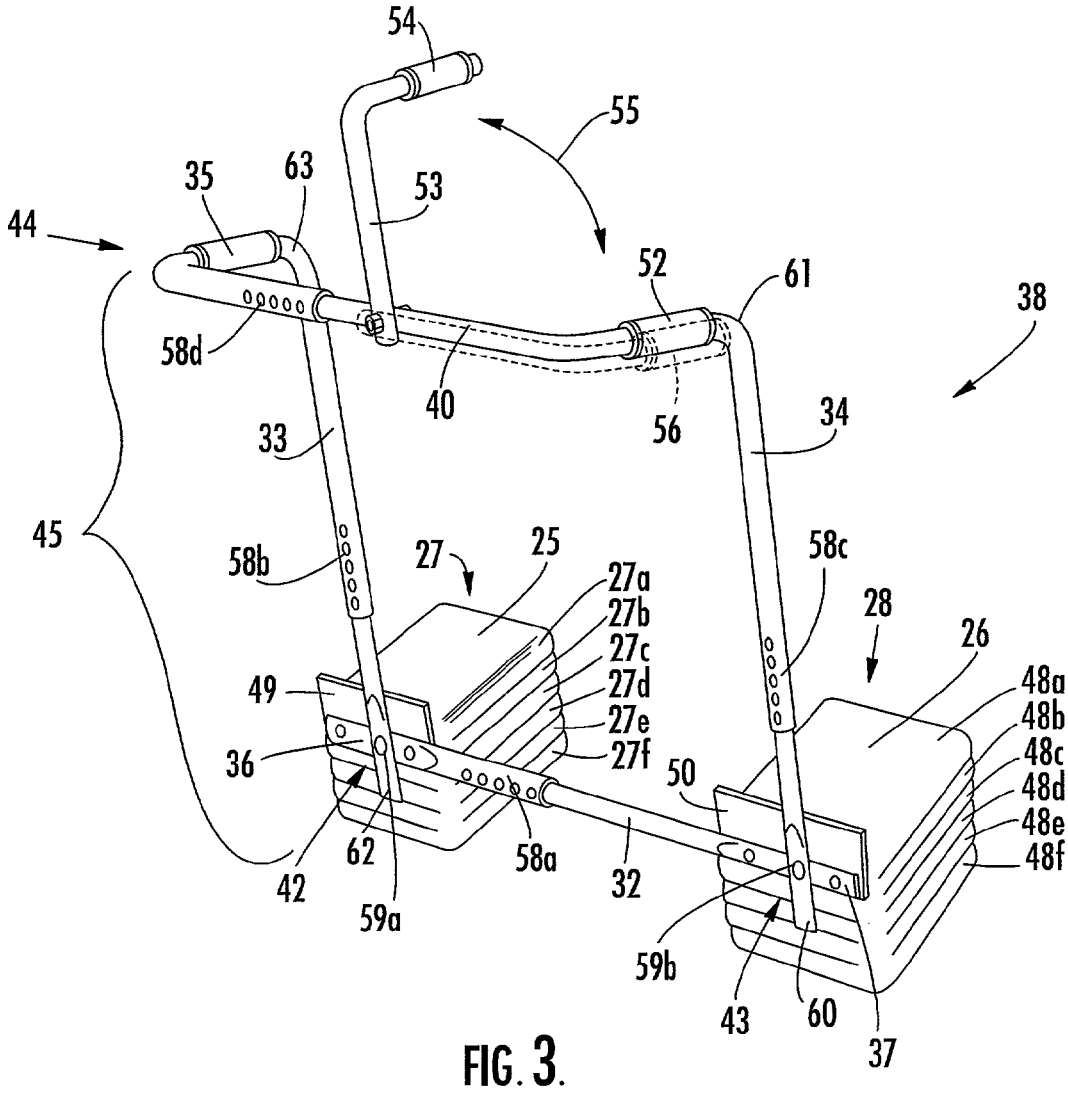
FIG. 3 is a view of the embodiment of FIG. 2, but viewed from the opposite side.

FIG. 2 shows a perspective view of the step-extending device 38 previously seen in FIG. 1. In FIG. 2, a frame 45 is comprised of a cross member 32, a first upright member 33 and second upright member 34. In some applications of the invention, there may be only one upright member, but the particular embodiment shown in FIG. 2 includes both a first upright member 33 and a second upright member 34. As shown in FIG. 3, the first end 62 of first upright member 33 is positioned adjacent first end 36 of cross member 32, and is connected thereto. The second end 63 of first upright member 33 is adjacent a first handle grip 35. The first handle grip 35 provides a convenient place for grasping device 38 by hand when moving the device 38 from one stair to another stair. First end 60 of second upright member 34 is positioned near the second end 37 of cross member 32, and connected thereto, while the second end 61 of the second upright member 34 is connected to and adjacent second handle grip 39.

Furthermore, FIG. 2 illustrates an optional feature of an extension 53 pivotally connected to horizontal bar 40. Extension 53 carries an extension handle grip 54. Horizontal bar 40 is formed at the juncture of first upright member 33 with second upright member 34, and may be formed with the second upright member 34 capable of telescoping within tubular first upright member 33. Extension 53 may be pivoted from a first erect and upright position as shown in FIG. 2 to a storage position parallel to horizontal bar 40. When not in use, the extension 53 may be folded along fold down direction 55 to a fold down or storage position 56 parallel to horizontal bar 40 as shown in dashed lines in the upper portions of FIGS. 2 and 3.

When a patient 21 is ascending or descending a stairway 20, the extension 53 provides a convenient means for moving the step-extending device 38 from one step to another, and the extension handle grip 54 may be capable of being reached by a patient 21 who is temporarily located at a higher position (on a higher step) than the device 38. Thus, this optional feature of extension handle grip 54 can in some instances make it more convenient for either an assistant 29 or the patient 21 to reposition the step-extending device 38 from one stair to another.

As shown in the embodiment of FIG. 2, the first base 27 can comprise a plurality of units 47*a-f*. Likewise, the second base 28 can comprise a plurality of units 48*a-f*. The units 47*a-f*, and 48*a-f* may be selectively removed or added to the step-extending device 38 to provide the device with an appropriate height of the first base 27 and second base 28 as necessary to approximately match the height of stair riser 24*a*, as seen in FIG. 1. The individual height of units 47*a-f*, 48*a-f* is predetermined to provide a given desired height for a given number of units in a stack of units.

Figure 6:
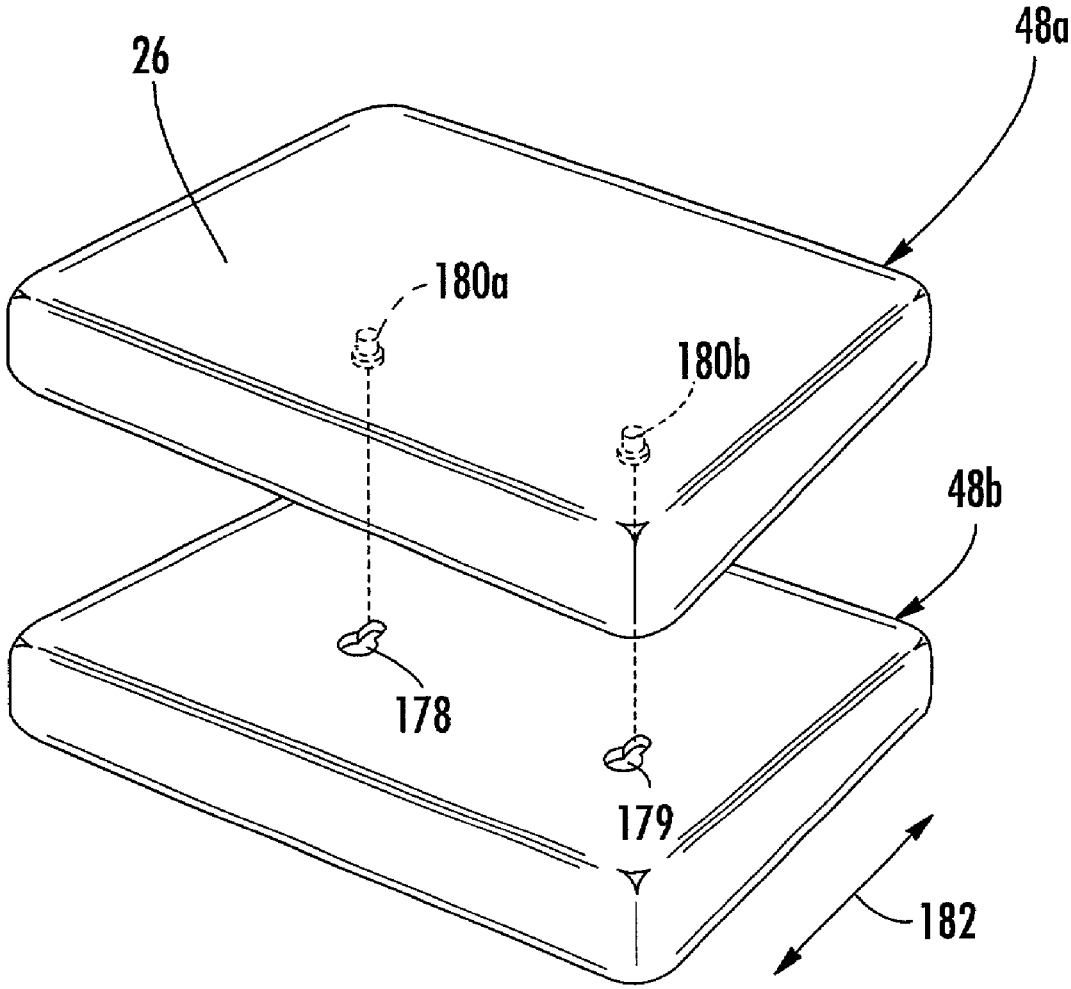
FIG. 6 shows one embodiment of the units that may be employed with the device of FIG. 5 to vary the height of a base.

Numerous means and apparatus may be provided to facilitate the selective stacking of units 48*a-f* upon each other to approximate a given total height. FIG. 6 shows one means by which a unit 48*a* and a unit 48*b*, for example, may be interlocked to each other. Each unit 48*a*, 48*b* defines a rigid plate having a flat planar upper surface opposite a flat planar lower surface. These may be locked to each other using a key hole 178, 179 which interacts with key posts 180*a*, 180*b*, respectively, as shown in FIG. 6. In other applications, the stacked units 48*a-f* could be molded and shaped such that they interlock together in a press-fit relationship. Units 48*a-f* may be provided as individual units which are interlocked to each other, or in other embodiments may comprise a single block structure. In some applications, the upper surface of the units 48*a* and 47*a* could be slightly depressed or concave so that walker legs 33-34 would be less likely to slip from the upper surface of the units 48*a* and 47*a*.

The units 47*a-f*, 48*a-f* may be comprised of wood, but preferably are comprised of a lighter material, such as plastic. They must be able to withstand the weight of the walker legs 30-31, and provide stiff exterior surfaces to avoid penetration of outer surfaces by walker legs 30-31 under force. The units 47*a-f*, 48*a-f* are configured for stacking upon each other in defining the height of the first and second bases. The footprints of the bases 27, 28 may be rectangular, as shown in FIG. 2, or can assume any other shape such as round, triangular, oval, rectangular, trapezoidal, and the like that provides a suitable stable platform having a relatively flat upper surface. It is not required that all units 48*a-f* and 47*a-f* assume the same geometric shape, but it is sometimes more convenient if the same shape is provided for all such units.

As shown in FIG. 3, the cross member 32 is connected to the first end 60 of the second upright member 34 by way of a bolt or screw 59*b* passing through the cross member 32 and the second upright member 34 and into one of the units 48*a-f*. Likewise, the first end 62 of the first upright member 33 is connected by way of a bolt or screw 59*a* that passes through cross member 32 and first upright member 33 and into one of the respective units 47*a-f*.

Adjusting the distance between first and second bases 27, 28 to accommodate differing widths of various walker models is shown schematically in FIG. 2 by arrow 41. Each of cross member 32 and horizontal bar 40 is configured for telescoping along its length, to provide adjustment of the overall width of the step-extending device 38. For example, adjustment mechanisms 58*a*, 58*d* are shown along the frame 45. The width adjustment mechanism 58*a* provides a spring-loaded detent for selective adjustment of the length of cross member 32, so that the distance between the first base 27 and the second base 28 corresponds to the width of the walker 22 (see FIG. 1). Likewise, width adjustment mechanism 58*d* provides a spring-loaded detent for adjustment of the length of horizontal bar 40. In each case, the spring loaded detent 58*a*, 58*d* fits into one of a group of holes found in the outer sleeve of the two-piece, telescoping mechanism that forms the respective cross member 32 or horizontal bar 40. Typically, the length of horizontal bar 40 and cross member 32 are correlated to each other to provide for width adjustment of the step-extending device 38.

Adjustment of the height of horizontal bar 40 may be accomplished by extending or retracting the first upright member 33 and the second upright member 34, as shown schematically in FIG. 2 by arrows 41*a* and 41*b* by adjustment means shown in FIG. 3. Height adjustment mechanisms 58*b*-58*c* (spring-loaded detent assemblies) adjust the first upright member 33 and second upright member 34, respectively. The described adjustment is provided to raise or lower horizontal bar 40.

Furthermore, in some instances height adjustment mechanisms 58*b* and 58*c* may be extended so that the height of the horizontal bar 40 is near its maximum. With the use of the extension 53 as a hand grip, the step-extending device 38 may be used by a patient 21 in some instances without any other human assistance.

In FIGS. 2-3, a first retaining wall 49 is shown extending from the first base 27, while a second retaining wall 50 is shown extending from the second base 28. In practice, the first and second retaining walls 49-50 serve to prevent the first downhill leg 30 and second downhill leg 31, respectively, of the walker 22 from inadvertently or accidentally slipping from the upper surface of the first base 27 and second base 28. Thus, the first retaining wall 49 and second retaining wall 50 assist in securing safe operation of the step-extending device 38, by keeping such walker legs from slipping off of the forward edge of the upper surface of the first and second bases 27, 28.

Figure 4:
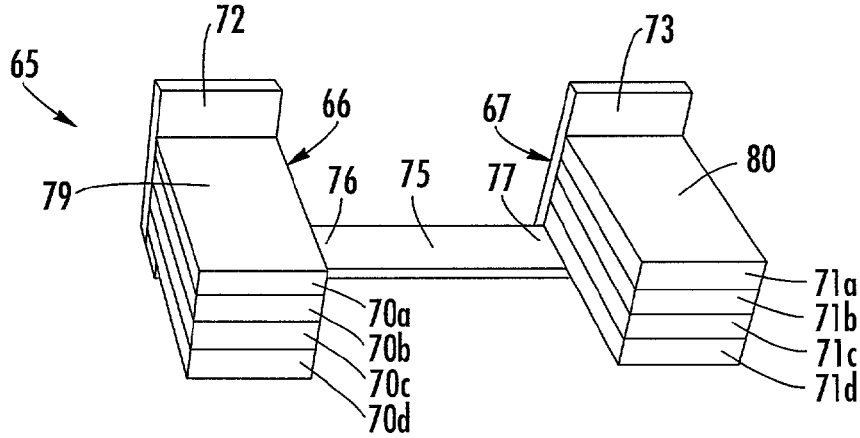
FIG. 4 shows an alternate embodiment of the invention.

In FIG. 4, an alternate embodiment of the step-extending device 65 is shown. A first base 66 and a second base 67 are connected by way of a cross member 75. First base 66 provides a plurality of units 70*a-d*. Furthermore, the second base 67 provides a plurality of units 71*a-d*. First base 66 and second base 67 each is configured to rest upon flat planar undersides (not shown in FIG. 4) upon a stair of a stairway. The cross member 75 has a first end 76 connected to the first base 66, and the second end 77 of the cross member 75 is connected to the second base 67. A first retaining wall 72 and a second retaining wall 73 are provided, respectively, on the first base 66 and the second base 67.

The embodiment of the invention shown in FIG. 4 may be repositioned from one stair to the next by picking up the device 65 and placing it upon the next stair, when the patient 21 is either ascending or descending the stairway. Typically, the step-extending device 65 would be oriented so that the first retaining wall 72 and second retaining wall 73 face away from the patient, similar to the orientation shown in FIG. 1 so that they are positioned to "catch" walker legs 30-31 that may undesirably slide upon the upper surfaces of the bases 66-67.

It should be noted that the first base 27 and second base 28, as shown in FIG. 1 and other Figures as well, may be of a fixed height, and need not necessarily include adjustable units similar to that shown in FIGS. 1-4. However, it has been found that the employment of units or sub-units facilitates the use of the step-extending device 38 for stairways which include stair heights that vary widely, i.e., from as little as 4 inches per stair to as much as 10 inches or more. That is, each unit in a stack of units may be provided in one (1) inch increments (as one example) which provides a suitable incremental variation resulting in the ability to provide a fairly precise approximation of a number of common stair heights. Other increments as little as ½ inch, or as great as 2 inches could be employed as well.

Figure 5:
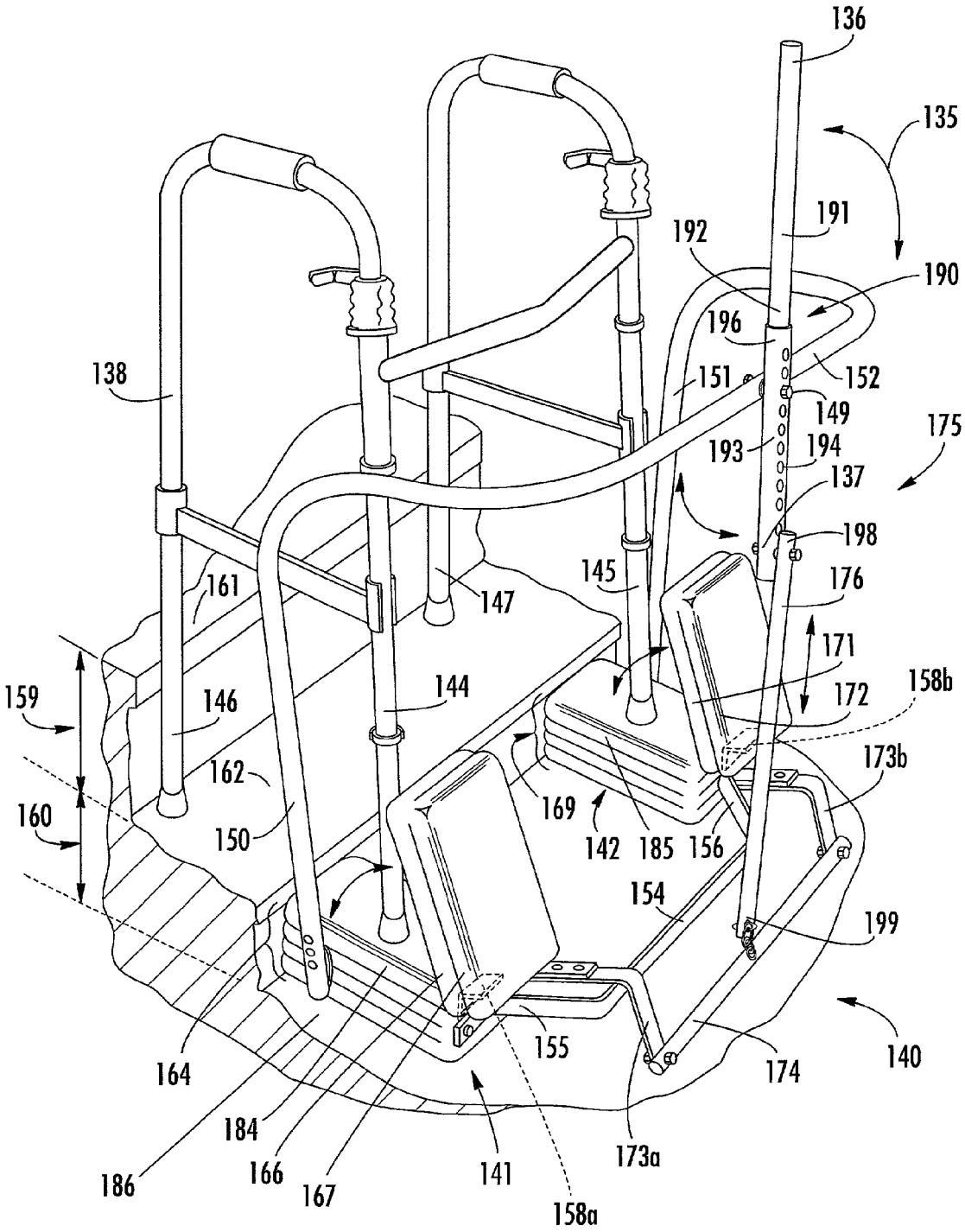
FIG. 5 shows yet another embodiment of the invention, in which a height adjustment mechanism is provided to selectively adjust the height of the first and second bases as a patient is ascending or descending a stairway.

Yet another embodiment of the invention is shown in FIG. 5. A step-extending device 140 is shown which has a "flip-top" feature that facilitates rapid and convenient change (or selective actuation) between a first base height and a second base height that is different from the first height.

The embodiment of the invention shown in FIG. 5 is particularly useful for stairways in which the first stair is significantly shorter or taller than the remaining stairs in a stairway. For example, it has been found that many stairways are constructed so that all of the stairs are of equal height, with the exception of the last or final stair. Building and construction personnel frequently construct one of the stairs in a given stairway at a different height than the remainder of the stairs. This "odd height" stair typically is the last stair at the bottom of the stairway. Thus, it has been found that a step-extending device 140 that is capable of providing a height adjustment means or height adjustment mechanism that may operably select or adjust the height of the first and second bases from a first predetermined height to a second predetermined height during traversal of the stairs may be quite useful.

Many patients find that during a period of recovery they must ascend different stairways in various different homes or buildings (and each having slightly different stair heights) during their recovery period. Thus, patients may adjust step-extending device 140 to accommodate the stair height they expect to encounter in their daily travels. The height adjustment feature provides a convenient means to ascend or descend stairs with minimal difficulty in association with a walker 138.

Turning to FIG. 5, a walker 138 includes a first downhill leg 144 and second downhill leg 145 resting respectively upon first base 141 and second base 142 of the step-extending device 140. The first uphill leg 146 and second uphill leg 147 of the walker 138 are resting upon first stair 162. A second stair 161 is positioned above first stair 162. The second height of the second stair 161 is shown schematically at the left side of FIG. 5 by an arrow designated 159. The first height of the first stair 162 also is shown schematically in FIG. 5 by an arrow designated 160. As mentioned, it is common for the bottom stair in a stairway (i.e. first stair 162) to be of a different height than the remaining stairs in the stairway. FIG. 5 illustrates that situation in which first height 160 is less than second height 159.

A cross member 154 connects at its first end 155 to the first base 141. Cross member 154 connects at its second end 156 to second base 142. Cross member 154 functions to provide rigid support between first base 141 and second base 142. Cross member 154 is bent outwards away from the area between first base 141 and second base 142 to afford room for the feet of patient 21, while the step-extending device 140 is in use.

The step-extending device 140 includes a first base 141, which is capable of configuration in two modes, each mode comprising a different height. A first height of first base 141 may be employed in which units 164 may be selectively combined with units 166 and 167 to form a full height. On the other hand, when in an adjusted height mode, a second shorter height is provided using grouped units 164 only. Likewise, on the opposite side of the step-extending device, a first height of a second base 142 may employ both grouped units 169, and also units 171, 172 in combination to achieve full height.

The number of units to be moved upwards or flipped is predetermined by the user, and the position of the first hinge 158*a* and second hinge 158*b* may be provided upon the first base 141 and second base 142 so that a lower first half of the respective pivoting hinges 158*a-b* is operably connected to the units 164 and 169, while the upper second half of the respective hinges 158*a-b* is connected to the units 166-167 and 171-172 (which are configured to flip upward as shown in FIG. 5). In a presently preferred embodiment, the hinges 158*a-b* each are screwed or bolted to one of the units 164 and 169, respectively. In the presently preferred embodiment, the lower portion of the first hinge 158*a* connects to hinged block 184. Likewise, the lower portion of second hinge 158*b* connects to hinged block 185. This connection may be by bolt or screw, or in some other embodiments the hinge can be integrally molded into the respective hinged blocks 184-185. The upper portion of hinge 158*a* is attached by a screw to unit 166. Likewise, second hinge 158*b* can be screwed or bolted into unit 171. Moreover, it usually would not be necessary to change the particular unit to which a particular hinge is attached. Instead, the overall height of the units 164 and 169 may be adjustably determined by selection of the number of units which are both above and below the first and second hinges 158*a*, 158*b*.

For example, in the particular configuration shown in FIG. 5, it was predetermined that the height of units 164 and 169 should be approximately equal to the first height 160 of first stair 162. To accomplish this, the hinged blocks 184, 185 were interconnected to additional units provided underneath them by way of the method shown and described herein in connection with FIG. 6. Likewise, unit 166 was interlocked with unit 167 in a similar manner. Unit 171 was interlocked with unit 172 in a similar manner. It is possible to preselect the number of units necessary to achieve the height required, for each of the two different modes (flipped and unflipped) wherein each mode comprises a different predetermined height. The first hinge 158*a* is connected to one unit on its upper half and one unit on its lower half. Likewise, second hinge 158*b* is connected to one unit on its upper half and one unit on its lower half.

FIG. 5 shows a reduced height 160 in which the first base 141 and second base 142 are made to accommodate the shorter first stair 162. In this particular instance, the step-extending device 140, while sitting on the floor 186, provides a height adjustment equal to the first height 160 of first stair 162. Then, when the step-extending device 140 is moved to the upper surface of second stair 161, the height adjustment required in that instance is equal to the second height 159 of second stair 161.

Many different mechanisms may be used to adjust the height of the first base 141 and second base 142. In FIG. 5, for example, a flip bar 174 is operably connected by a bolt on one end to a first angle iron 173*a* and by a bolt on another end to a second angle iron 173*b*. The respective angle irons 173*a-b* are each connected, respectively, by a bolt or screw to unit 166 and unit 171. In this embodiment, the bolt passes directly through a hole in the angle irons 173*a-b*, then through the hinges 158*a*, 158*b*, and directly into the respective units 166 and 171, respectively. Thus, angle irons 173*a-b* are fixed to respective units 166, 171 so that downward movement of flip bar 174 as described below will cause movement of units 166-167 and units 171-172 up and away from units 164 and 169, respectively, as in FIG. 5. This movement results in what is sometimes referred to herein as the "flipped" mode or second mode.

One method of adjusting height is by actuating the flip bar 174 with a foot, by pushing down on the flip bar 174 to move interconnected units 166-167 and interconnected units 171-172 (for example) up and away. The units 166-167, 171-172 are moved upwards from the first and second bases 141, 142 so that first and second bases 141, 142 assume a lower second height adapted for receiving downhill legs 144-145 of the walker 138 when a stair of a reduced height is encountered, such as first stair 162 in FIG. 5.

In another method of actuating the flip bar 174, a lever 175 may be deployed. As shown in FIG. 5, for example, lever 175 defines a telescoping section 190. The telescoping section defines a distal end 137, and the telescoping section 190 is pivotally connected to the horizontal bar 152. The lever 175 defines a first rigid rod 176 having opposite ends 198-199. The first end 199 of the first rigid rod 176 is pivotally connected to the flip bar 174. The opposite second end 198 of the first rigid rod 176 is pivotally connected to the distal end 137 of the telescoping section 190. The telescoping section 190 also includes a hollow tube 193. The tube 193 defines a proximal end 196 and a distal IS end 137. The telescoping section 190 also includes a second rigid rod 191, having a distal end 192 and a proximal end 136. A hole (not shown) is provided through the distal end 192 of rod 191. The tube 193 further defines a plurality of adjustment holes (i.e., hole 194, for example) defined transversely through tube 193 and spaced apart along the length of the tube 193. The distal end 192 of the second rigid rod 191 is slidably disposed within the proximal end 196 of the tube 193, and is pivotally connected to the horizontal bar 152, such as by means of a bolt 149 disposed through the hole in the distal end 192 and through an aligned one of the holes 194 in tube 193.

Lever 175 has two actuating positions for effecting different modes of operation for the first and second bases 141, 142. One actuating position is shown in FIG. 5 and results in a smaller base height. A second actuating position (not shown in FIG. 5) results in a greater base height in which lever 175 is oriented horizontally and parallel to horizontal bar 152.

Lever 175 may be rotated as shown by arrow 135 in FIG. 5. Rotation of lever 175 so as to raise the distal end 137 of telescoping section 190, thereby raises flip bar 174. This movement changes the step-extending device 140 from a first mode having a first height to a second mode having a second height. In the horizontal actuating position of lever 175, the units 166-167 and 171-172 are in the down position or mode so that the maximum height of first base 141 and second base 142 is achieved. Thus, the lever 175 is configured to activate the first rigid rod 176 to push the flip bar 174 up or down, as needed to adjust or switch between modes, thereby adjusting the height of the first base 141 and the second base 142 by moving respective units 166-167 and units 171-172 upwards as shown and previously discussed in connection with FIG. 5.

It should be recognized that one may selectively adjust the number of units 166-167 and 171-172 which are adjusted or deployed in the practice of the invention, as shown in FIG. 5. That is, one may predetermine two different heights, one to correspond with a known shorter stair, and one to correspond with a known taller stair. Once a predetermination of the necessary height(s) is made, various adjusting means or mechanisms may be employed to ensure that the appropriate number of units 166-167 or 171-172 are activated during actuation of the flip bar 174, as previously described. The presently preferred means is by selection of the number of units for attachment to each side of respective hinges 158*a-b*.

In some applications, the lever 175 may be used by a patient 21 to adjust from one base height to another base height, while in other applications lever 175 could be used by an assistant 29 for such a height adjustment, helping a patient 21 ascend or descend a stairway.

Figure 7:
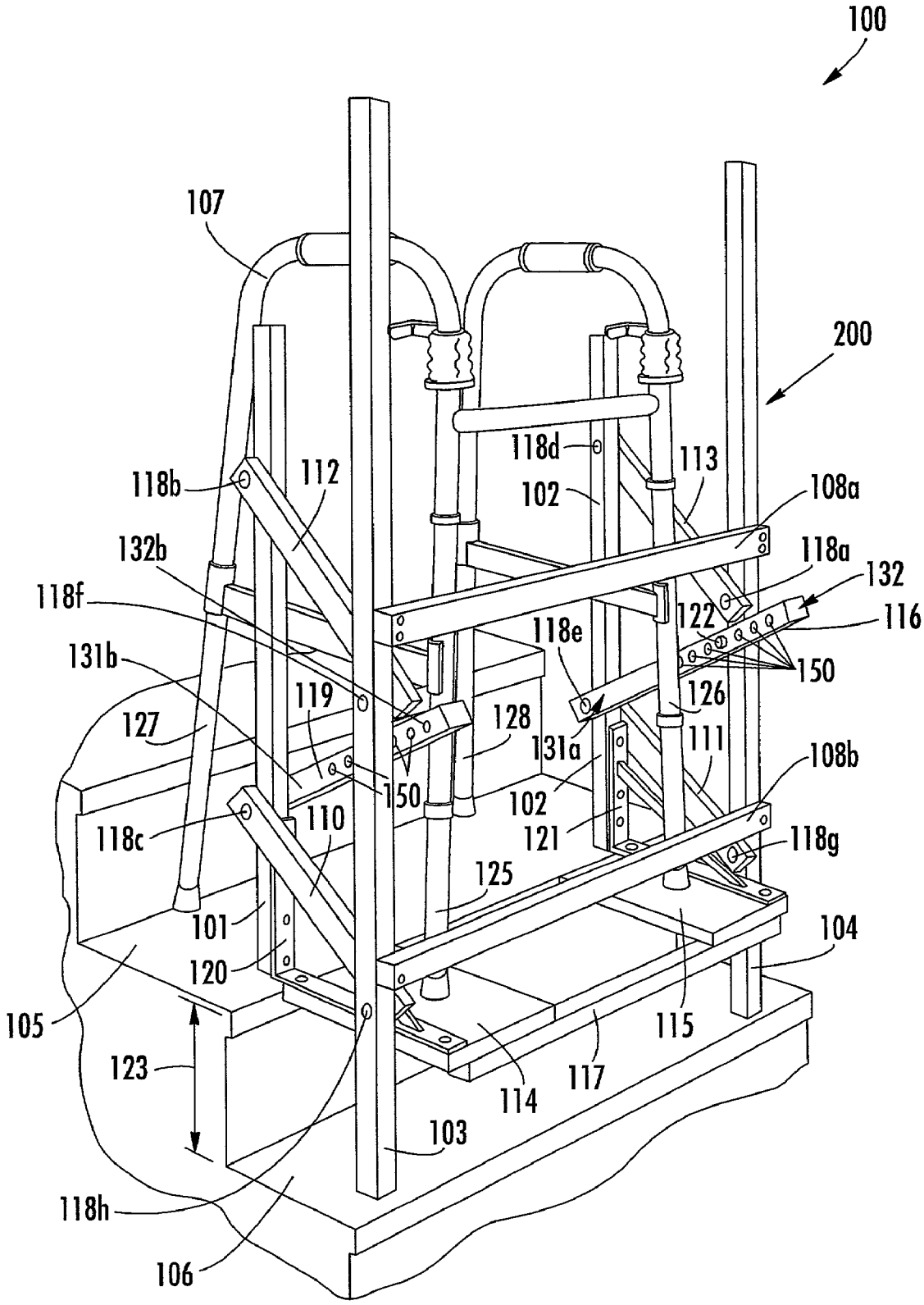
FIG. 7 illustrates yet another embodiment of the invention that is capable of self-adjusting to variable stairway height.

Yet another embodiment of the invention is shown in FIG. 7, which displays in perspective view a self-adjusting step-extending device 100. The self-adjusting step-extending device 100 is used to assist a person using a walker 107 to negotiate stairs. The walker 107 includes a first uphill leg 127 and a second uphill leg 128, shown near the back side of a stair tread 105. The walker 107 also includes a first downhill leg 125 and a second downhill leg 126. Device 100 does not require the removal or the addition of stackable units to accommodate varying stair heights as shown in the embodiment of FIG. 5, but includes a frame 200 capable of adjusting during use with stairs of varying height.

A first uphill leg 101 and a second uphill leg 102 are provided as part of the frame 200, and the respective bottom surfaces of first uphill leg 101 and second uphill leg 102 rest on stair tread 105 as shown in FIG. 7. The frame 200 includes a pair of downhill legs, including a first downhill leg 103 and a second downhill leg 104, which have their respective bottom surfaces positioned in FIG. 7 to rest upon stair tread 106. When the self-adjusting, step-extending device 100 is placed upon stair treads 105, 106, the vertical height differential between the bottom surfaces of the paired first and second downhill legs 103, 104 and the bottom surfaces of the paired first and second uphill legs 101, 102 is approximately equal to the tread height that is schematically represented by the two-headed arrow designated by the numeral 123 shown in the lower left portion of FIG. 7. The self-adjusting step-extending device 100 is capable of adjusting to the tread height 123 when used on a stairway having a tread height 123 that varies from one step to the next.

As shown in FIG. 7, a first base 114 is connected to a first leg of a right angle bracket 120, which has a second leg that connects to the lower back portion of the first uphill leg 101 in a manner such that the bottom of the first uphill leg 101 is held at about the same level as the upper support surface of the first base 114. Likewise, a second base 115 connects to a first leg of a second right angle bracket 121, which has a second leg that connects to the lower back portion of the second uphill leg 102 in a manner such that the bottom of the second uphill leg 102 is held at about the same level as the upper support surface of the second base 115. As shown in FIG. 7, when the device 100 is stabilized upon a stairway, the upper support surfaces of the first base 114 and second base 115 support the first downhill leg 125 and second downhill leg 126, respectively, of the walker 107. Thus, the right angle brackets 120, 121 must be sturdy enough to carry the anticipated weight that is supported by the downhill legs 125, 126 of the walker 107 and typically would be formed of metal.

Each of a first lateral member 108*a* and a second lateral member 108*b* extends between and provides horizontal support between first downhill leg 103 and second downhill leg 104. Furthermore, a base connector member 117 provides support between first base 114 and second base 115, stabilizing the overall device 100.

As shown in FIG. 7, the frame 200 includes a first side member 110, a second side member 111, a third side member 112, and a fourth side member 113. One of the two opposite ends of each side member is pivotally connected to one of the two uphill legs 101, 102, while the other end of each side member is pivotally connected to one of the two downhill legs 103, 104.

Pivoting connectors 118*a-h* provide connection points between the side members and the legs of the frame 200 on the self-adjusting step-extending device 100. For example, pivoting connectors 118*d* and 118*a* are provided for pivoting connection between fourth side member 113 and, respectively, second uphill leg 102 and second downhill leg 104. Furthermore, pivoting connectors 118*e* and 118*g* are provided to connect opposite ends of second side member 111, respectively, to second uphill leg 102 and second downhill leg 104. The third side member 112 and first side member 110 each pivotally connect to the first uphill leg 101 and first downhill leg 103 by way of pivoting connectors 118*b*, 118*f* and 118*c*, 118*h* respectively.

A first latching member 116 adjustably connects second uphill leg 102 to the second downhill leg 104. A second latching member 119 adjustably connects the first uphill leg 101 to the first downhill leg 103. Pivoting connectors 118*e*, 118*c* are provided at one end of respective latching members 116, 119. The adjustable engagement of the latching members 116, 119 to the first and second downhill legs 103, 104, respectively, facilitates the adjustment of the distance between first and second uphill legs 101, 102 and first and second downhill legs 103, 104. This separation distance determines the difference in elevation between the upper support surfaces of the first and second bases 114, 115 and the bottoms of the first and second downhill legs 103, 104.

As shown in FIG. 7, latching members 116 and 119 having respective first ends 131*a-b* and second ends 132*a-b* include a plurality of spaced apart receiving holes 150 along the lengths of latching members 116, 119 in the vicinity of second ends 132*a-b*. Receiving holes 150 are desirably circular and provided at predetermined intervals along at least a portion of the length of latching members 116, 119.

Furthermore, a first peg 122 is provided to extend from the inner-facing side surface of second downhill leg 104. The first peg 122 has an exterior shape that is adapted for engagement with each of holes 150 of first latching member 116, for example. Similarly, a second peg is provided to extend from the inner-facing side surface of first downhill leg 103 and is not visible in the view shown in FIG. 7. The second peg is configured with a circular cross-sectional shape so as to be pivotally received in engagement with each of the holes 150 in second latching member 119. In accordance with the present invention, the elevation of the respective upper surfaces of the first base 114 and second base 115 relative to the bottom surfaces of the two downhill legs 103, 104 is adjustable according to which one of the holes 150 in the respective latching members 116, 119 engages the respective pegs (such as first peg 122, for example) of the two downhill legs 103, 104.

The self-adjusting step extending device 100 provides the opportunity to position the first base 114 and second base 115 at varying heights in order to accommodate different stair heights. To commence use, the first latching member 116 and the second latching member 119 are allowed to hang vertically downward from their respective pivot points (i.e., hanging from pivoting connection 118*e* and pivoting connection 118*c*). Once the first uphill leg 101 and second uphill leg 102 are firmly placed upon the surface of stair tread 105, then the user moves the two downhill legs 103, 104 toward or away from the two uphill legs 101, 102 until the upper surfaces of the bases 114, 115 are level with the stair tread 105 and the bottoms of the two downhill legs 103, 104 rest firmly upon the stair tread 106. Then the user pivots the first latching member 116 and the second latching member 119 upward to connect them to the first and second downhill legs 103, 104 by engaging the appropriate receiving holes 150 of the first latching member 116 and the second latching member 119 with the corresponding connecting peg (e.g., 122) on the first and second downhill legs 103, 104. The self-adjusting step-extending device 100 is then prepared to accommodate the tread height 123 of the stair. During use, the self-adjusting step-extending device 100 is placed initially in a position and configuration like that shown in FIG. 7, wherein the first downhill leg 125 and second downhill leg 126 of the walker 107 are supported by first base 114 and second base 115, respectively.

In use, the walker 107 is supported atop the bases 114, 115, and then lifted slightly from the self-adjusting step-extending device 100. The device 100 is lifted away from the surfaces of the stair treads 105, 106 and repositioned upon the next successive stair tread (in either ascending or descending manner of use). Once the self-adjusting step-extending device 100 is repositioned, the downhill legs 125, 126 of the walker 107 can be supported again by the upper support surfaces of the bases 114, 115.

Once the stairway has been traversed, and device 100 is then positioned at either the top or bottom of the stairway, the first latching member 116 and second latching member 119 may be disengaged from the respective downhill legs 103, 104. Once disengagement occurs, then the pivoting connectors 118*a-h* facilitate pivoting articulation between the legs 101, 102, 103, 104 and the first, second, third, and fourth side members 110, 111, 112, 113, and the latching members 116 and 119. Then, the device 100 will stand upon a flat surface once more.

In another embodiment of the invention, the self-adjusting extending device 100 could be provided without latching members 119, 120. In this alternate embodiment, the first and second uphill legs 101, 102 and the first and second downhill legs 103, 104 would not lock with respect to the side members 110, 112, 113, and 111. In yet another embodiment of the invention, one or more of the side members 112, 110, 113, and 111 could be configured with a locking ratchet located at the intersection of the side member with a respective uphill leg or downhill leg 101-104. Thus, a ratchet mechanism could be configured to selectively lock at a given angle between a side member 110-113 and an uphill or downhill leg 101-104. Such a ratchet mechanism could be used as an alternative to latching members 119, 120 to fix the angle between the side members 110-113 and the uphill and/or downhill legs 101-104.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A step-extending device configured for assisting persons to walk upon steps of a stairway using a four-point walker, comprising:

(a) a first base and a second base, each of said first and second bases defining a flat planar underside configured to rest unattended upon a first step when the device is in use, each of said first and second bases further defining a flat planar upper surface disposed above each respective underside and disposable in use to support one leg of the walker at a height substantially equal to the step disposed above said first step, each of said bases defining a height extending vertically between said flat planar underside and said flat planar upper surface;

(b) a cross member, said cross member comprising a first end and a second end, said first end of said cross member being attached to said first base, said second end of said cross member being attached to said second base, wherein said device is selectively operable between a first mode and a second mode;

wherein in said first mode each of said first and second bases includes a first predetermined number of units stacked upon each other to define a first height; and wherein in said second mode each of said first and second bases includes a second predetermined number of units stacked upon each other to define a second height different from said first height;

(c) a first hinge pivotally connecting at least two of said units of said first base;

(d) a second hinge pivotally connecting at least two of said units of said second base; and (e) a flip bar having a first end connected to one of said hinged units of said first base, said flip bar having a second end disposed opposite said first end and connected to one of said hinged units of said second base, wherein pivoting movement of said flip bar reconfigures the device between said first and second modes.

2. The device of claim 1, further comprising a lever having a first end and a second end opposite said first end, said second end being pivotally connected to said flip bar, wherein said lever is configured and disposed so that activation of said lever effects said pivoting movement of said flip bar.

3. The device of claim 2, further comprising:

a first upright member extending vertically from at least one of said cross member and one of said bases, said first upright member including a first end connected to at least one of said cross member and one of said bases and having a second end positioned above said first end;

a second upright member extending vertically from at least one of said cross member and one of said bases, said second upright member having a first end connected to at least one of said cross member and one of said bases and having a second end positioned above said first end;

a horizontal bar connecting said first upright member and said second upright member; and wherein said lever is pivotally mounted upon said horizontal bar.

4. The device of claim 3, wherein pivoting of said lever relative to said horizontal bar effects said pivoting movement of said flip bar, thereby changing said step-extending device from said first mode to said second mode.

5. The device of claim 3, wherein said lever defines a telescoping section, said telescoping section defining a distal end, said telescoping section being pivotally mounted upon said horizontal bar, said lever further defining a first rigid rod having opposite ends, one of said opposite ends of said first rigid rod being pivotally connected to said flip bar and the other of said opposite ends of said first rigid rod being pivotally connected to said distal end of said telescoping section.

6. The device of claim 5, wherein said telescoping section includes a second rigid rod and a rigid hollow tube, said tube defining a proximal end, said distal end of said telescoping section being formed by a distal end of said tube and disposed opposite said proximal end of said tube, said tube further defining a plurality of along the length of said tube between said proximal and distal ends, said proximal end of said rigid tube being pivotally mounted upon said horizontal bar, said second rod defining at least one adjustment hole transversely through one end thereof and said one end of said second rigid rod being slideably disposed within said proximal end of said tube.

7. A step extending device configured for assisting persons who require a four-point walker in order to render themselves self-ambulatory under their own power, to walk upon steps of a stairway using a four-point walker, the stairway having a plurality of vertically extending risers, each riser being disposed between adjacent steps, which extend horizontally, the step extending device comprising:

(a) a first base and a second base, said first base defining a fiat planar underside configured to rest unattended upon a first step when the device is in use on a stairway, said second base defining a flat planar underside configured to rest unattended upon the same first step at the same time as the first base is resting unattended on the same first step when the device is in use on the same stairway, each of said first and second bases further defining a horizontally flat, rigid, non-moving planar upper surface extending the length and width of each respective base and disposed above each respective underside and disposable in use to support one leg of the walker at a height substantially equal to the height of a step that is disposed above said first step, each of said bases defining a height extending vertically between said flat planar underside and said flat planar upper surface, said second base being disposed horizontally spaced apart from said first base to define a vacant volume of space between said bases, said vacant volume of space being large enough to permit the assisted person to stand between the bases while the bases and the assisted person are simultaneously resting on the same step, each said base defining a forward portion and a rearward portion that is disposed opposite and spaced horizontally apart from said forward portion;

(b) a cross member, said cross member comprising a first end and a second end, said first end of said cross member being attached to and contacting said first base and said second end of said cross member being attached to and contacting said second base such that said cross member is disposed closer to said rearward portions of said first and second bases than to said forward portions of said first and second bases such that said cross member does not preclude the person being assisted from standing between the two bases on the same step on which the two bases are also then being supported and while the riser of the stairway is disposed closer to the forward portions of both of the bases than the rearward portions of both of the bases; and a first upright member extending vertically from at least one of said cross member and said first base, said first upright member including a first end positioned adjacent one of said first base and said cross member, said first upright member including a second end positioned above said first end, said first upright member having a length extending from said first end to said second end;

a second upright member extending vertically from at least one of said cross member and said second base, said second upright member having a first end connected to at least one of said cross member and said second base, said second upright member defining a second end positioned above the first end;

a horizontal bar connecting said first upright member and said second upright member; and an extension projecting upwards from said horizontal bar, said extension being adapted to facilitate grasping of said step extending device.

* * * * *